United States Patent [19]

Robinson, Jr. et al.

[11] Patent Number: 4,919,410

[45] Date of Patent: Apr. 24, 1990

[54] APPARATUS FOR DETERMINING COPY SHEET SET THICKNESS

[75] Inventors: Norman D. Robinson, Jr., Rochester; Michael E. Farrell, Fairport, both of N.Y.

[73] Assignee: Xerox Corporation, Stamford, Conn.

[21] Appl. No.: 192,074

[22] Filed: May 10, 1988

[51] Int. Cl.[5] ..... B65H 3/04

[52] U.S. Cl. ..... 271/34; 271/155

[58] Field of Search ..... 270/37, 53; 271/34, 271/258, 259, 263, 154, 155, 31; 377/8

[56] References Cited

U.S. PATENT DOCUMENTS 4,417,351 11/1983 Williamson et al. ..... 377/8

4,535,463 8/1985 Ito et al. ..... 377/8

4,730,823 3/1988 Barela ..... 271/155

4,770,403 9/1988 Katsumata ..... 271/154

*Primary Examiner*—Richard A. Schacher

*Attorney, Agent, or Firm*—H. Fleischer; J. E. Beck; R. Zibelli

[57] ABSTRACT

An apparatus in which the approximate thickness of a set of sheets is determined. A tray supporting a stack of sheets thereon is periodically indexed a preselected distance each time the thickness of the stack of sheets decreases by a specified amount. The approximate thickness of the set of sheets is calculated as a function of the number of times the tray is indexed and a constant corresponding to the preselected distance the tray indexes.

20 Claims, 4 Drawing Sheets

APPARATUS FOR DETERMINING COPY SHEET SET THICKNESS

This invention relates generally to an electrophotographic printing machine, and more particularly concerns an apparatus for determining the approximate thickness of a set of copy sheets.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In a high speed commercial printing machine of the foregoing type, large volumes of copy sheets having the fixed toner powder image thereon are compiled into sets of copy sheets. Each set of copy sheets corresponds to a set of original documents being reproduced in the printing machine. The compiled sets of copy sheets are advanced to the finishing station of the printing machine. At the finishing station, the sheets of the set of copy sheets are stapled together. In order to insure that the set of copy sheets will not jam the set transport advancing the set of copy sheets to the finishing station and that the stapler capacity is not exceeded, it is necessary to monitor the thickness of the set of copy sheets advanced to the finishing station. Typically, staplers are rated by the thickness of the paper stack that they can staple and set transports by the height of the set of sheets they can accept. Hereinbefore, the printing machine control strategy counted the number of copy sheets in the set and assumed that all of the sheets were of the same thickness, e.g. 20 pound weight sheets. Thus, the printing machine restricted the stapling and set transport operations to sets of copy sheets having less than a prescribed number of sheets. This control strategy does not provide for thicker or thinner copy sheets or a mix of copy sheets having differing thickness. For example, if the copy sheets are thicker than 20 pound weight paper, e.g. card stock for covers, the set could be too thick causing the set transport and/or the stapler to jam. Alternatively, if sheets thinner than 20 pound weight paper were used, e.g. onion skin paper, the control strategy could inhibit stapling and/or set transport for a set of sheets that were of acceptable thickness. Similarly, the capacity of a duplex tray is also limited by the number of 20 pound weight paper and the control strategy does not provide for a mix of thicker or thinner copy sheets. More sophisticated commercial printing machines having chapterization and slip sheeting capabilities, may use differing weight sheets. It is evident that a printing machine of this type requires a more sophisticated control strategy. The following disclosures appear to be relevant:

US-A-4,417,351
Patentee: Williamson et al.
Issued: November 22, 1983
US-A-4,535,463
Patentee: Ito et al.
Issued: August 13, 1985

The relevant portions of the foregoing patents may be summarized as follows:

US-A-4,417,351 discloses a stacked article counting apparatus for counting the number of sheet-like articles, e.g. papers in a stack by multiplying the stack height times a factor corresponding to the number of sheets per unit measurement to obtain the number of sheets left in the stack.

US-A-4,535,463 describes an apparatus for detecting the number of remaining sheets in a copying machine. A movable paper tray provides an initial height of a paper stack, the actual number of sheets used are counted. From these monitored values, the number of sheets remaining in the tray and the height of the remaining stack of papers in the tray can be calculated.

In accordance with one aspect of the present invention, there is provided an apparatus for determining the approximate thickness of a set of sheets. The apparatus includes a tray for supporting a stack of sheets thereon. Means are provided for advancing successive sheets from the stack of sheets on the tray to form the set of sheets. Means periodically index the tray a preselected distance each time the thickness of the stack of sheets decreases by a specified amount. Means calculate the approximate thickness of the set of sheets as a function of the number of times the tray is indexed and a constant corresponding to the preselected distance the tray is indexed.

Pursuant to another feature of the present invention, there is provided an electrophotographic printing machine for reproducing a set of original documents. In the printing machine, successive copy sheets are advanced from a stack of copy sheets on a tray to various processing stations to form a set of copy sheets corresponding to the set of original documents and the approximate thickness of the set of copy sheets is determined. The improvement includes means for periodically indexing the tray a preselected distance each time the thickness of the stack of copy sheets decreases by a specified amount. Means are provided for calculating the approximate thickness of the set of copy sheets as a function of the number of times the tray is indexed and a constant corresponding to the preselected distance the tray is indexed.

Still another feature of the present invention is a method of determining the thickness of a set of copy sheets used in an electrophotographic printing machine having a plurality of processing stations to reproduce a set of original documents. The method includes the steps of supporting a stack of copy sheets on a tray. Successive copy sheets are advanced from the stack of copy sheets on the tray to the processing stations of the printing machine to form a set of copy sheets. The tray is indexed periodically a preselected distance each time the thickness of the stack of copy decreases by a specified amount. The approximate thickness of of the set of copy sheets is calculated as a function of the number of times the tray is indexed and a constant corresponding to the preselected distance the tray is indexed.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents, as may be included within the spirit and scope of the invention as defined by the appended claims.

Figure 1:
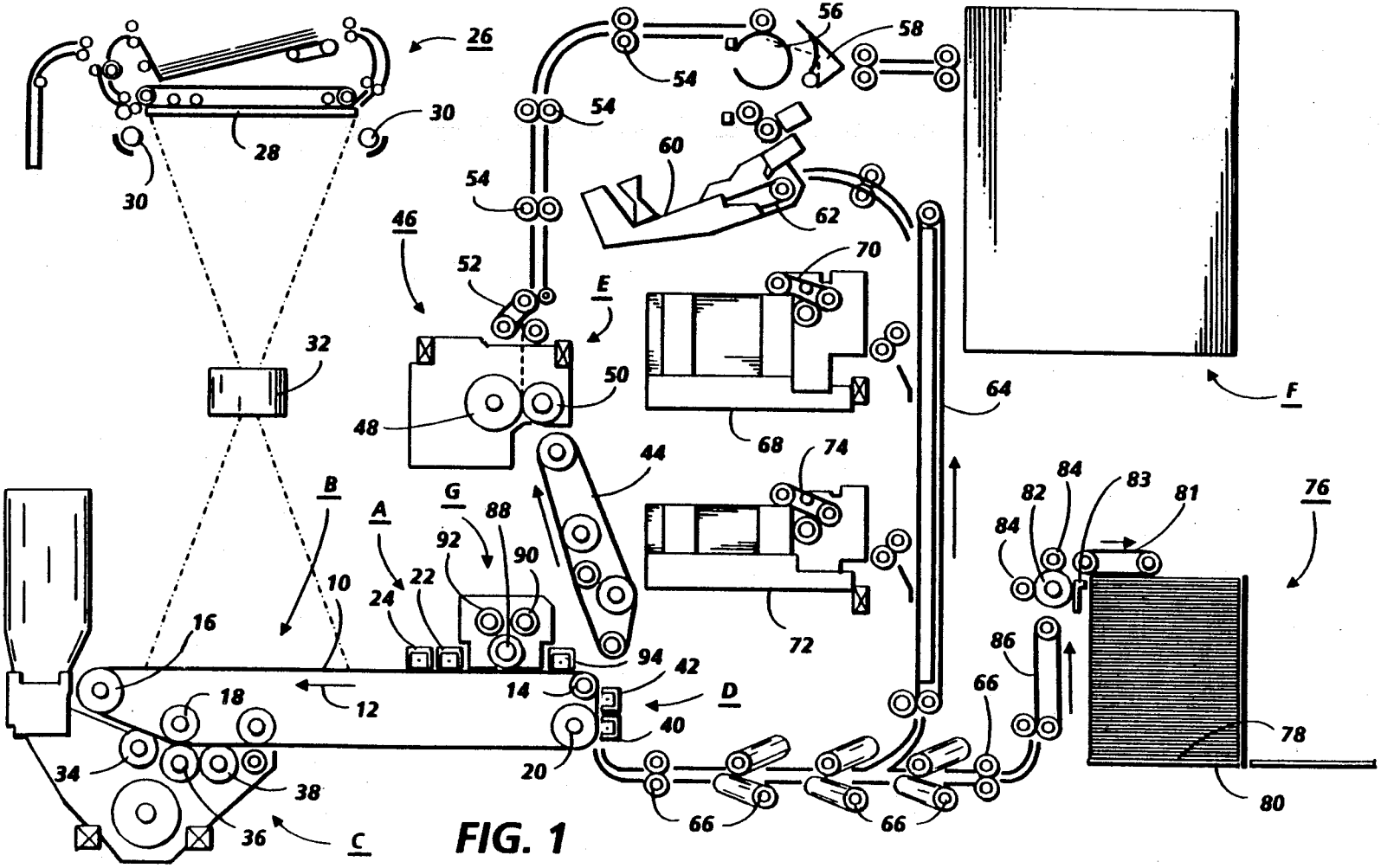
FIG. 1 is a schematic elevational view depicting an illustrative electrophotographic printing machine incorporating the apparatus of the present invention therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the sheet handling apparatus of the present invention may be employed in a wide variety of devices and is not specifically limited in its application to the particular embodiment depicted herein.

Referring to FIG. 1 of the drawings, the electrophotographic printing machine employs a photoconductive belt 10. Preferably, the photoconductive belt 10 is made from a photoconductive material coated on a ground layer, which, in turn, is coated on a anti-curl backing layer. The photoconductive material is made from a transport layer coated on a selenium generator layer. The transport layer transports positive charges from the generator layer. The generator layer is coated on an interface layer. The interface layer is coated on the ground layer made from a titanium coated Mylar. The interface layer aids in the transfer of electrons to the ground layer. The ground layer is very thin and allows light to pass therethrough. Other suitable photoconductive materials, ground layers, and and anti-curl backing layers may also be employed. Belt 10 moves in the direction of arrow 12 to advance successive portions sequentially through the various processing stations disposed about the path of movement thereof. Belt 10 is entrained about stripping roller 14, tensioning roller 16, idler roller 18, and drive roller 20. Stripping roller 14 and idler roller 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station A. At charging station A, two corona generating devices, indicated generally by the reference numerals 22 and 24 charge the photoconductive belt 10 to a relatively high, substantially uniform potential. Corona generating device 22 places all of the required charge on photoconductive belt 10. Corona generating device 24 acts as a leveling device, and fills in any areas missed by corona generating device 22.

Next, the charged portion of the photoconductive surface is advanced through imaging station B. At imaging station B, a document handling unit, indicated generally by the reference number 26, is positioned over platen 28 of the printing machine. Document handling unit 26 sequentially feeds documents from a stack of documents placed by the operator face up in a normal forward collated order in the document stacking and holding tray. A document feeder located below the tray forwards the bottom document in the stack to a pair of take-away rollers. The bottom sheet is then fed by the rollers through a document guide to a feed roll pair and belt. The belt advances the document to platen 28. After imaging, the original document is fed from platen 28 by the belt into a guide and feed roll pair. The document then advances into an inverter mechanism and back to the document stack through the feed roll pair. A position gate is provided to divert the document to the inverter or to the feed roll pair. Imaging of a document is achieved by lamps 30 which illuminate the document on platen 28. Light rays reflected from the document are transmitted through lens 32. Lens 32 focuses light images of the original document onto the charged portion of photoconductive belt 10 to selectively dissipate the charge thereon. This records an electrostatic latent image on the photoconductive belt which corresponds to the informational areas contained within the original document. Thereafter, belt 10 advances the electrostatic latent image recorded thereon to development station C.

Development station C has three magnetic brush developer rolls, indicated generally by the reference numerals 34, 36 and 38. A paddle wheel picks up developer material and delivers it to the developer rolls. When developer material reaches rolls 34 and 36, it is magnetically split between the rolls with half the developer material being delivered to each roll. Photoconductive belt 10 is partially wrapped about rolls 34 and 36 to form extended development zones. Developer roll 38 is a cleanup roll. A magnetic roll, positioned after developer roll 38, in the direction of arrow 12, is a carrier granule removal device adapted to remove any carrier granules adhering to belt 10. Thus, rolls 34 and 36 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet is moved into contact with the toner powder image. First, photoconductive belt 10 is exposed to a pre-transfer light from a lamp (not shown) to reduce the attraction between photoconductive belt 10 and the toner powder image. Next, a corona generating device 40 charges the copy sheet to the proper magnitude and polarity so that the copy sheet is tacked to photoconductive belt 10 and the toner powder image attracted from the photoconductive belt to the copy sheet. After transfer, corona generator 42 charges the copy sheet to the opposite polarity to detack the copy sheet from belt 10. Conveyor 44 advances the copy sheet to fusing station E.

Fusing station E includes a fuser assembly, indicated generally by the reference numeral 46 which permanently affixes the transferred toner powder image to the copy sheet. Preferably, fuser assembly 46 includes a heated fuser roller 48 and a pressure roller 50 with the powder image on the copy sheet contacting fuser roller 48. The pressure roller is cammed against the fuser roller to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfers to a donor roll and then to the fuser roll.

After fusing, the copy sheets are fed through a decurler 52. Decurler 52 bends the copy sheet in one direction to put a known curl in the copy sheet and then bends it in the opposite direction to remove that curl.

Forwarding rollers 54 then advance the sheet to duplex turn roll 56. Duplex solenoid gate 58 guides the sheet either to the finishing station F or to duplex tray 60. At finishing station F, copy sheets are stacked in a compiler tray to form sets. The set of copy sheets is advanced by a set transport to a stapler. The sheets of the set of copy sheets are attached to one another by the stapler. The set transport and stapler are disabled in the event the thickness of the set of copy sheets exceeds a preselected thickness. After the set of copy sheets are stapled, the stapled set of copy sheets is advanced to a set tray for removal from the printing machine by the operator. When duplex solenoid gate 58 diverts the sheets into duplex tray 60. Duplex tray 60 provides an intermediate or buffer storage for those sheets that have been printed on one side and on which an image will be subsequently printed on the second, opposed side thereof, i.e. the sheets being duplexed. The sheets are stacked in duplex tray 60 face down on top of one another in the order in which they are copied.

In order to complete duplex copying, the simplex sheets in tray 60 are fed, in seriatim, by bottom feeder 62 from tray 60 back to transfer station D via conveyor 64 and rollers 66 for transfer of the toner powder image to the opposed sides of the copy sheets. Inasmuch as successive bottom sheets are fed from duplex tray 60, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets are fed to transfer station D from the secondary tray 68. The secondary tray 68 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 70. After the thickness of the stack of copy sheets has decreased by a specified amount, a motor is energized for a selected time period to rotate lead screws to index the tray upwardly a preselected distance. By way of example, a photosensor is used to generate a control signal. When the set of copy sheets blocks the light path of the photosensor, the motor rotating the lead screw is deenergized. When the photosensor is unblocked, the motor is energized. This positions the uppermost copy sheet adjacent the sheet feeder. Sheet feeder 70 is a friction retard feeder utilizing a feed belt and take-away rolls to advance successive copy sheets to transport 64 which advances the sheets to rolls 66 and then to transfer station D.

Copy sheets may also be fed to transfer station D from the auxiliary tray 72. The auxiliary tray 72 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 74. After the thickness of the stack of copy sheets has decreased by a specified amount, a motor is energized for a selected time period to rotate lead screws to index the tray upwardly a preselected distance. By way of example, a photosensor is used to generate a control signal. When the set of copy sheets blocks the light path of the photosensor, the motor rotating the lead screw is deenergized. When the photosensor is unblocked, the motor is energized. This positions the uppermost copy sheet adjacent the sheet feeder. Sheet feeder 74 is a friction retard feeder utilizing a feed belt and take-away rolls to advance successive copy sheets to transport 64 which advances the sheets to rolls 66 and then to transfer station D.

Secondary tray 68 and auxiliary tray 72 are secondary sources of copy sheets. A high capacity feeder, indicated generally by the reference numeral 76, is the primary source of copy sheets. High capacity feeder 76 includes a tray 78 supported on an elevator 80. The elevator is driven by a bidirectional AC motor to move the tray up or down. After the thickness of the stack of copy sheets has decreased by a specified amount, a motor is energized for a selected time period to rotate lead screws to index the tray upwardly a preselected distance. By way of example, a photosensor is used to generate a control signal. When the set of copy sheets blocks the light path of the photosensor, the motor rotating the lead screw is deenergized. When the photosensor is unblocked, the motor is energized. This positions the uppermost copy sheet adjacent the sheet feeder. In the up position, the copy sheets are advanced from the tray to transfer station D. A fluffer and air knife 83 direct air onto the stack of copy sheets on tray 78 to separate the uppermost sheet from the stack of copy sheets. A vacuum pulls the uppermost sheet against feed belt 81. Feed belt 81 feeds successive uppermost sheets from the stack to an take-away drive roll 82 and idler rolls 84. The drive roll and idler rolls guide the sheet onto transport 86. Transport 86 advances the sheet to rolls 66 which, in turn, move the sheet to transfer station station D. The thickness of the set of copy sheets is determined as a function of the number of times the tray is indexed a preselected distance. The technique for determining the thickness of the set of copy sheets will be described hereinafter with reference to the high capacity feeder. However, the thickness of the set of copy sheets may be found in the same manner as hereinafter described for the secondary tray and the auxiliary tray. Inasmuch as the technique is identical for any of the sheet feeders, only the operation of the high capacity feeder will be described in detail. Further details of the operation of high capacity feeder 76 and the manner in which the thickness of the set of copy sheets is determined will be described hereinafter with reference to FIGS. 2 through 4, inclusive.

One skilled in the art will appreciate that there are many types of devices that will index the tray the preselected distance and that the present invention is not limited to the motor and lead screw arrangement. For example, the tray may be indexed by a cable which spools onto a motor driven pulley.

Invariably, after the copy sheet is separated from the photoconductive belt 10, some residual particles remain adhering thereto. After transfer, photoconductive belt 10 passes beneath corona generating device 94 which charges the residual toner particles to the proper polarity. Thereafter, the pre-charge erase lamp (not shown), located inside photoconductive belt 10, discharges the photoconductive belt in preparation for the next charging cycle. Residual particles are removed from the photoconductive surface at cleaning station G. Cleaning station G includes an electrically biased cleaner brush 88 and two de-toning rolls 90 and 92, i.e. waste and reclaim de-toning rolls. The reclaim roll is electrically biased negatively relative to the cleaner roll so as to remove toner particles therefrom. The waste roll is electrically biased positively relative to the reclaim roll so as to remove paper debris and wrong sign toner particles. The toner particles on the reclaim roll are scraped off and deposited in a reclaim auger (not shown), where it is transported out of the the rear of cleaning station G.

The various machine functions are regulated by a controller. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the documents and the copy sheets. In addition, the controller regulates the various positions of the gates depending upon the mode of operation selected. Thus, when the operator selects the finishing mode, a stapling apparatus will be be energized and the gates will be oriented so as to advance either the simplex or duplex copy sheets to finishing station F.

Figure 2:
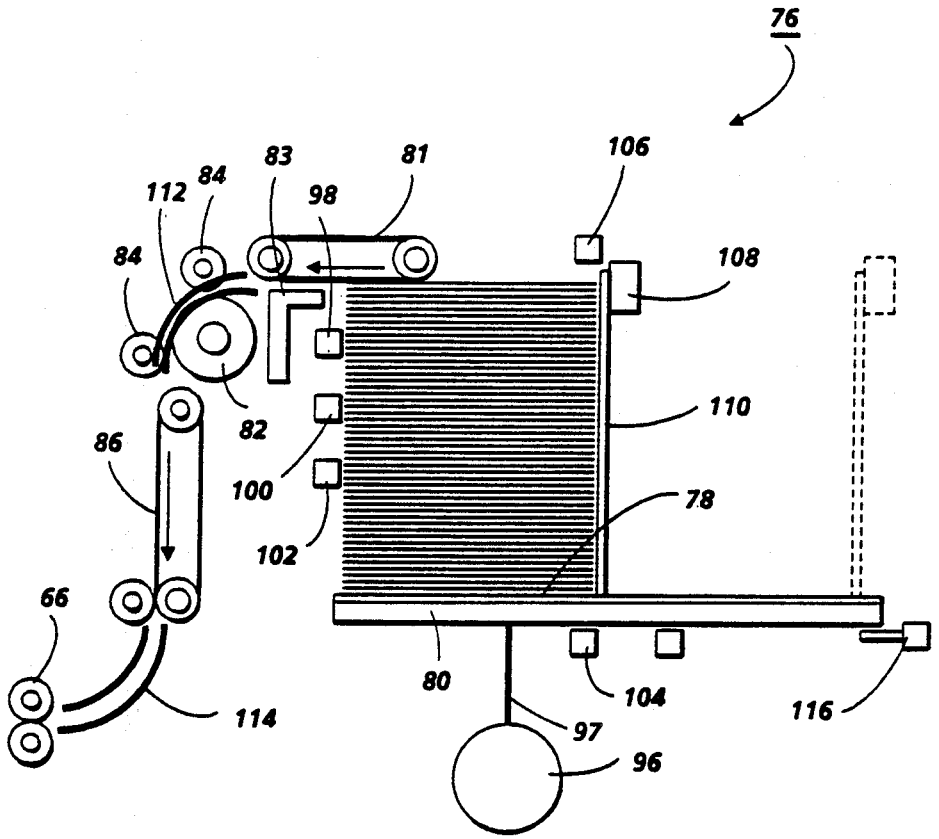
FIG. 2 is a schematic elevational view showing an exemplary sheet feeding apparatus used in the FIG. 1 printing machine.

Referring now to FIG. 2, high capacity feeder 76 includes a tray 78 supported on an elevator 80. Elevator 80 is driven by a bidirectional AC motor 96. Motor 96 rotates a plurality of lead screws 97 to drive elevator 80 having tray 78 supported thereon up and down. Position sensors 98 and 100 are used to maintain the loading level while the tray is being loaded. Sensor 98 also indicates that there is approximately one-half a ream, i.e. about 250 sheets, in the tray. Sensor 100 also indicates that there is one ream or 500 sheets left in the tray. Position sensor 102 is located midway between sensor 100 and down limit switch 104. Sensor 102 provides information to the control system that there is approximately three reams of paper with each ream having about five hundred sheets left in the tray. Up limit switch 106 and down limit switch 104 de-energize motor 96 to prevent the elevator from moving the tray too far in the vertical direction. Stack height switch sensor 108 is mounted on movable rear guide 110 and insures that the uppermost sheet of the stack is in correct position for feeding. During feeding, the control logic monitors the stack height switch sensor 108. When the signal from the stack height switch sensor 108 goes high, after the next sheet is fed, motor 96 is turned on for 40 milliseconds until the signal from the stack height switch sensor 108 goes low. Normally, 6 to 12 sheets of paper are fed between indexes. The pitch of the lead screws 97 is selected so that the elevator 80 and tray 78 supported thereon move 1.5 millimeters during the 40 millisecond period that motor 96 is energized. In this way, the uppermost sheet of the stack is maintained in a sheet feeding position with respect to feed belt 81. The control logic has a counter and a timer. The timer is energized each time a new set of copy sheets is being reproduced. The counter counts the number of times that motor 96 is energized to index elevator 80 and tray 78 during the reproduction of a set of copy sheets. This corresponds to the number of times that stack height sensor switch 108 goes high. The count signal is sent to a multiplier or amplifier having a scale factor corresponding to the indexing distance, i.e. 1.5 millimeters. The output from the multiplier or amplifier corresponds to the thickness of the copy set, i.e. the product of the number of times the motor is indexed times a constant equal to the indexing distance (1.5 millimeters). This signal is compared to a reference to determine whether or not the set transport and stapler of the finishing station should be inhibited. If the thickness of the set of copy sheets is greater than a preselected thickness, the signal corresponding thereto will be greater than the reference and the stapler and set transport will be inhibited. Alternatively, if the signal corresponding to the thickness of the set of copy sheets is less than the prescribed thickness, as indicated by the reference, the set transport and stapler will be operable. Preferably, stack height switch sensor 108 is a photosensor including a flight source and a photodetector. The photosensor signal is low when the light path is blocked and the signal from the photodetector indicates the absence of light. At this time the sheets of the stack are interposed between the light source and the photodetector breaking the light path. The photosensor signal is high when the light path is unblocked and the signal from the photodetector indicates the presence of light. At this time, the sheets of the stack are not interposed between the light source and the photodetector so that the light path is unbroken. When the photosensor signal is high, motor 96 is energized for 40 milliseconds moving the stack of copy sheets on tray 78 upwardly the prescribed distance of 1.5 millimeters. Thus, the uppermost sheet is positioned in a sheet feeding relationship with respect to feed belt 81. Air knife and fluffer 83 direct air onto the stack of copy sheets in the sheet feeding position. There are two fluffers blowing against the lead edge of the stack of copy sheets, and one fluffer blowing against the rear edge of stack of copy sheets. As the top sheet is separated from the remaining sheets in the stack, the vacuum pulls the top sheet against feed belt 81. The air knife is then used to separate the next copy sheet from the remainder of the sheets in the stack as the prior top copy sheet is advanced by feed belt 81 into baffle 112. Take away drive roller 82 cooperates with idler rollers 84 to move the sheet onto vertical transport 86. Transport 86 moves the sheet into baffle 114 which guides the sheet into the nip defined by roller pairs 66. As shown in FIG. 1, roller pairs 66 move the sheet to transfer station B.

Figure 3:
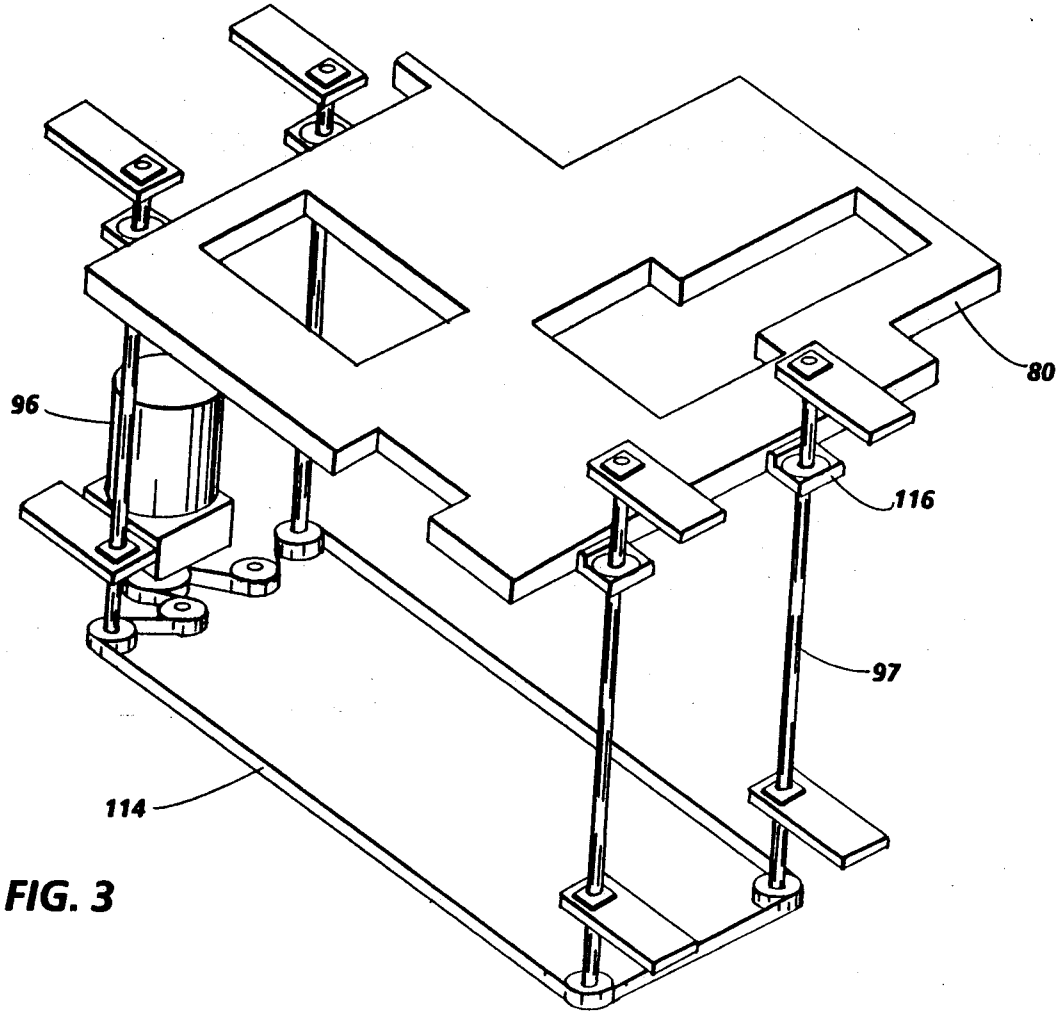
FIG. 3 is a schematic perspective view depicting the indexing apparatus used in the FIG. 2 sheet feeding apparatus.

Referring now to FIG. 3, there is shown further details of the manner in which elevator 80 is indexed. As shown in FIG. 2, elevator 80 has tray 78 mounted thereon with the stack of copy sheets supported thereon. With continued reference to FIG. 3, drive motor 96 is a bi-directional 115 Volt AC motor that raises and lowers elevator 80. A 100 millisecond delay is required before reversing the motor direction. The motor capacitor insures that the motor starts and runs in the correct direction. In order to protect the motor against damage caused by the complete or partial seizing of the elevator 80, the motor contains an internal sensor. If the motor becomes too hot, the sensor switches off the motor. The thermal sensor resets automatically when the motor cools. When the motor 96 is switched on in order to raise or lower elevator 80, the elevator 80 is moved by a drive belt 114. One drive belt 114 connects the drive from motor 96 to the four lead screws 97. A spring (not shown) attached to the motor and frame applies tension to the drive belt. Elevator 80 is connected to the four lead screws 97 by lift nuts 116. The lift nuts are adjustable, in order to maintain tray 78 mounted on elevator 80 substantially parallel to the sheet feeder. Two triacs mounted on a remote board are associated with the motor. One triac is used to raise elevator 80 with the other being required to lower elevator 80. The control logic determines when to index elevator 80. In response to a high signal from stack height switch sensor 108, the control logic sends a 5 volt signal to the triac. The triac then sends AC power to the motor 96 and capacitor and switches on motor 96 for 40 milliseconds. After 40 milliseconds, the control logic switches off the 5 volt signal to the triac so as to deenergize motor 96. The pitch of lead screws 96 is selected so that a 40 millisecond rotation of the lead screws will translate elevator 80 a fixed preselected distance of 1.5 millimeters.

Figure 4:
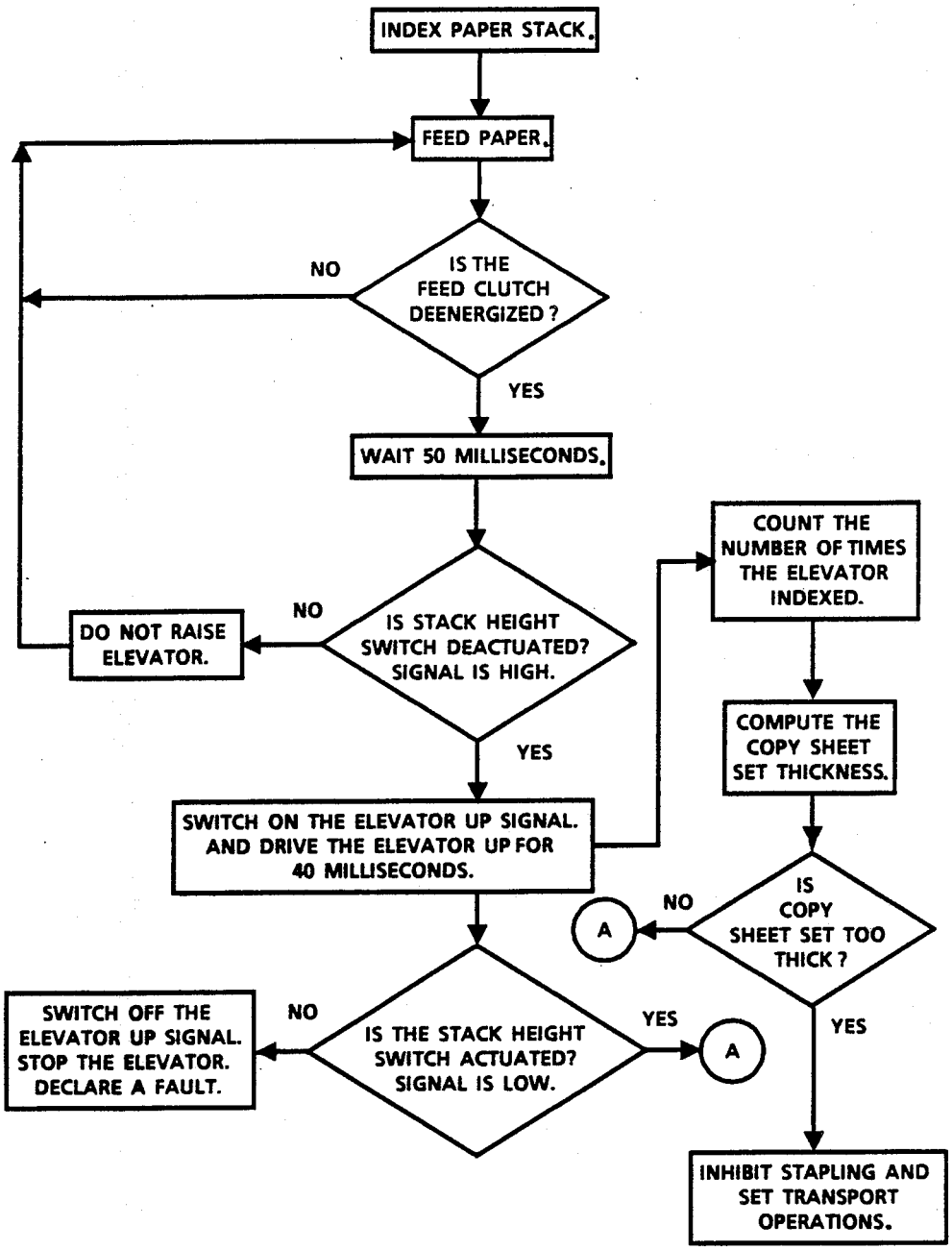
FIG. 4 is a flow diagram showing the indexing of the copy sheet support and the determination of the thickness of the set of copy sheets.

Turning now to FIG. 4, there is shown a flow diagram indicating the manner in which the thickness of the set of copy sheets is determined. As illustrated thereat, the control logic initially determines that the sheet feeder is deenergized, i.e. the clutch is deenergized. There then is a 50 millisecond delay and the stack height switch sensor 108 is interrogated. If the stack height switch sensor signal is high, motor 96 is energized for 40 milliseconds to move the stack of copy sheets upwardly a distance of 1.5 millimeters. The control logic then once again interrogates stack height switch sensor 108. If the signal from the stack height switch sensor is low, motor 96 is deenergized and the copy sheet feeding cycle resumed. If the signal from the stack height switch sensor is high, a fault is declared and the motor is deenergized. The number of times motor 96 is energized to index elevator 80 during the formation of the set of copy sheets is counted. The copy set thickness is computed by multiplying the count corresponding to the number of times the elevator has been indexed with a constant, i.e. 1.5 millimeters, corresponding to the distance the elevator has been indexed each time. If the copy sheet set is determined to be too thick, the stapling and set transport operations in the finishing station are inhibited. Alternatively, if the thickness of the set of copy sheets is acceptable, the stapling and set transport operations in the finishing station are enabled.

In recapitulation, the apparatus of the present invention determines the approximate thickness of a set of copy sheets being reproduced in an electrophotographic printing machine. Each time the thickness of the stack of copy sheets decreases by a specified amount, the tray supporting the stack of copy sheets is indexed a preselected distance. The number of times the tray is indexed is counted. The count of the number of times the tray is indexed is multiplied by a constant corresponding to the fixed preselected indexing distance to calculate the approximate thickness of the set of copy sheets.

It is, therefore, evident that there has been provided, in accordance with the present invention, an apparatus that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

We claim:

1. An apparatus for determining the approximate thickness of a set of sheets, including:

a tray for supporting a stack of sheets thereon;

means for advancing successive sheets from the stack of sheets on said tray to form the set of sheets;

means for periodically indexing said tray a preselected distance each time the thickness of the stack of sheets decreases by a specified amount; and means for calculating the approximate thickness of the set of sheets as a function of the number of times said indexing means indexes said tray and a constant corresponding to the preselected distance said tray indexes.

2. An apparatus according to claim 1, wherein said indexing means moves said tray in a vertical direction.

3. An apparatus according to claim 2, wherein said advancing means advances successive uppermost sheets from the stack of sheets on said tray.

4. An apparatus according to claim 3, further including means for detecting the sheets of the uppermost marginal region of the stack of sheets and generating a signal when the sheets of the uppermost marginal region are beneath a preselected location, said indexing means being responsive to the signal from said detecting means to index said tray the preselected distance to maintain the sheets of the uppermost marginal region of the stack of sheets at a preselected location.

5. An apparatus according to claim 4, wherein said calculating means includes:

means for counting the number of times said indexing means indexes said tray and generating a signal corresponding thereto; and means for forming the product of the signal from said counting means and the constant to determine the approximate thickness of the set of sheets.

6. An apparatus according to claim 5, wherein said indexing means includes:

at least one lead screw having said tray mounted thereon; and a motor coupled to said lead screw so that rotation of said of said lead screw moves said tray in the vertical direction.

7. An electrophotographic printing machine for reproducing a set of original documents wherein successive copy sheets are advanced from a stack of copy sheets on a tray to various processing stations of the printing machine to form a set of copy sheets corresponding to the set of original documents and the approximate thickness of the set of copy sheets is determined, wherein the improvement includes:

means for periodically indexing the tray a preselected distance each time the thickness of the stack of copy sheets decreases by a specified amount; and means for calculating the approximate thickness of the set of copy sheets as a function of the number of times said indexing means indexes the tray and a constant corresponding to the preselected distance the tray indexes.

8. A printing machine according to claim 7, further including:

means for comparing the calculated thickness of the set of copy sheets with a reference and generating a control signal; and means, responsive to the control signal, for inhibiting the operation of at least one of the processing stations of the printing machine when the control signal indicates that the calculated thickness of the set of copy sheets is greater than the reference.

9. A printing machine according to claim 7, wherein said indexing means moves the tray in a vertical direction.

10. A printing machine according to claim 9, wherein said advancing means advances successive uppermost sheets from the stack of sheets on the tray.

11. A printing machine according to claim 10, further including means for detecting the sheets of the uppermost marginal region of the stack of sheets and generating a signal when the sheets of the uppermost marginal region are beneath a preselected location, said indexing means being responsive to the signal from said detecting means to index said tray the preselected distance to maintain the sheets of the uppermost marginal region of the stack of sheets at a preselected location.

12. A printing machine according to claim 11, wherein said calculating means includes:

means for counting the number of times said indexing means indexes said tray and generating a signal corresponding thereto; and means for forming the product of the signal from said counting means and the constant to determine the approximate thickness of the set of sheets.

13. A printing machine according to claim 12, wherein said indexing means includes:

at least one lead screw having the tray mounted thereon; and a motor coupled to said lead screw so that rotation of said of said lead screw moves said tray in the vertical direction.

14. A method of determining the thickness of a set of copy sheets used in an electrophotographic printing machine having a plurality of processing stations to reproduce a set of original documents, including the steps of:

supporting a stack of copy sheets on a tray;

advancing successive copy sheets from the stack of copy sheets on the tray to the processing stations of the printing machine to form the set of copy sheets;

indexing periodically the tray a preselected distance each time the thickness of the stack of copy sheets decreases by a specified amount; and calculating the approximate thickness of the set of copy sheets as a function of the number of times the tray is indexed and a constant corresponding to the preselected distance the tray indexes.

15. A method according to claim 14, further including the steps of:

comparing the calculated thickness of the set of copy sheets with a reference and generating a control signal indicative of the difference therebetween; and inhibiting the operation of at least one of the processing stations of the printing machine when the control signal indicates that the calculated thickness of the set of copy sheets is greater than the reference.

16. A method according to claim 14, wherein said step of indexing moves the tray in a vertical direction.

17. A method according to claim 16, wherein said step of advancing advances successive uppermost copy sheets from the stack of copy sheets on the tray.

18. A method according to claim 17, further including the step of detecting the sheets of the uppermost marginal region of the stack of sheets and generating a signal when the sheets of the uppermost marginal region are beneath a preselected location, said step of indexing being responsive to the signal to index the tray the preselected distance to maintain the copy sheets of the uppermost marginal region of the stack of copy sheets at a preselected location.

19. A method according to claim 18, wherein said step of calculating includes the step of:

counting the number of times the tray is indexed the preselected distance and generating a signal corresponding thereto; and forming the product of the signal generated during said step of counting said counting means with the constant to determine the approximate thickness of the set of copy sheets.

20. A method according to claim 19, wherein said step of indexing means the step of rotating at least one lead screw having the tray mounted thereon to move the tray in the vertical direction.

* * * * *